US007069183B2

(12) United States Patent
Schluecker et al.

(10) Patent No.: US 7,069,183 B2
(45) Date of Patent: Jun. 27, 2006

(54) EARLY FAULT DETECTION IN PUMP VALVES

(75) Inventors: Eberhard Schluecker, Obarsulm (DE); Ralf Benken, Wiernsheim (DE); Michael Stritzelberger, Well der Stadt (DE)

(73) Assignee: LEWA Herbert Ott GmbH + Co. KG, Leonberg (DE)

( * ) Notice: Subject to any disclaimer, the term of this patent is extended or adjusted under 35 U.S.C. 154(b) by 70 days.

(21) Appl. No.: 10/845,170

(22) Filed: May 14, 2004

(65) Prior Publication Data

US 2004/0226346 A1 Nov. 18, 2004

(30) Foreign Application Priority Data

May 16, 2003 (DE) ..... 103 22 220

(51) Int. Cl.
*G06F 7/40* (2006.01)

(52) U.S. Cl. ..... 702/185; 702/130; 702/182; 702/183

(58) Field of Classification Search ..... 702/19, 702/20, 24, 25, 30, 130, 183, 185, 188; 417/63; 607/30; 701/16

See application file for complete search history.

(56) References Cited

U.S. PATENT DOCUMENTS

| | | | | |
|---|---|---|---|---|
| 5,000,664 | A * | 3/1991 | Lawless et al. | 417/63 |
| 5,439,355 | A * | 8/1995 | Jimison et al. | 417/63 |
| 6,731,216 | B1 * | 5/2004 | Ho et al. | 340/608 |

FOREIGN PATENT DOCUMENTS

| | | |
|---|---|---|
| DE | 199 47 570 | 4/2001 |
| JP | 11117875 | 4/1999 |
| JP | 2002041143 | 2/2002 |

* cited by examiner

*Primary Examiner*—Marc S. Hoff
*Assistant Examiner*—Felix Suarez
(74) *Attorney, Agent, or Firm*—Jacobson Holman PLLC

(57) ABSTRACT

In a process for the monitoring and automatic early fault detection in valves, in particular intake and/or pressure valves, of an oscillating displacement pump, in particular a membrane dosing pump, it is provided that the increased operating noise produced by a leaky valve due to the back-flow of the fluid being pumped in the closed state of the valve is used as a measure for the leakiness of the valve by the generated effective signal level being monitored continuously and compared to a reference signal level formed from the operating noise of the pump with an intact valve, where, at a predefined level deviation or change due to increased operating noise, early fault detection is triggered. A device for carrying out of this process includes a corresponding measuring device, in particular in the form of a vibration acceleration sensor measuring the produced structure-borne sound as well as a comparator device.

16 Claims, 3 Drawing Sheets

Intake Pump

Defective Intake Valve

Defective Pressure Valve

EARLY FAULT DETECTION IN PUMP VALVES

FIELD OF THE INVENTION

The invention relates to a process for the monitoring and automatic early fault detection in valves, in particular intake and/or pressure valves, of an oscillating displacement pump, in particular a membrane dosing pump. The invention relates furthermore to a device, provided for carrying out of this process.

BACKGROUND OF THE INVENTION

In the case of oscillating displacement pumps, above all, however, in the case of membrane dosing pumps, the pump valves, in particular the intake and/or pressure valves, have a decisive effect on the pump function.

The intake and/or pressure valves are subjected to constant wear, which has a negative effect on the displacement of the pump as well as on its dosing precision.

In practice, it has previously been attempted to eliminate this problem by promptly exchanging the valves based on experience.

Despite this, it cannot be avoided that valves fail prematurely. This causes undesirable subsequent damage, which is undesirable due to the necessary interruption of operation.

SUMMARY OF THE INVENTION

Thus, the invention is based on the objective of providing, for the elimination of the disadvantages described, a process as well as a device by means of which it is possible to monitor the valves of a pump of the generic type in such a manner that automatic early fault detection in valves results so that valve damage can be recognized promptly and an interruption in operation of the pump can be planned.

The process according to the invention is based on the essential idea of using the increased operating noise produced by a leaky valve due to the back-flow of the fluid being pumped in the closed state of the valve as a measure for the leakiness of the valve. For this purpose, the generated effective signal level is monitored continuously and compared to a reference signal level formed from the operating noise of the pump with intact valve, where, at a predefined level deviation or change due to increased operating noise, early fault detection is triggered.

The invention makes use, in an advantageous manner, of the effect that in an intact pump a certain background noise is to be recognized. In this case, several discrete typical individual noises occur simultaneously. They have different causes such as, for example, the engagement of teeth in the step-down gear in the pump mechanism or the opening and closing noises of the valves.

In contradistinction thereto, valves which have become leaky produce increased typical operating noise due to the back-flow of the fluid being pumped in the closed state of the valve.

This increased operating noise depends on the amount of back-flow of the fluid being pumped and is used according to the invention as a measure for the leakiness of the valve.

Thus, for example, an increased noise level is to be recognized in the case of a defective intake valve during the displacement phase, i.e. during the pressure stroke, while, in the case of a defective pressure valve, an increased noise level occurs during the intake phase, i.e. during the intake stroke.

The intake and pressure valves finding application in oscillating displacement pumps, in particular the membrane dosing pumps under discussion here, are customarily either ball valves, plate valves, or plug valves which can be spring-loaded or pressure-controlled. In this case, the requirements placed on these valves consist of the fact that they must open and close precisely at the correct point in time and that they must be leaktight in the time provided.

The damage possibly occurring in such valves expresses itself either in a notch leakage produced by one or more notches in the valve seat, where local damage occurs, or of surface leakage producing flat-surface damage. In this case, the sealing edge of the valve seat is not damaged pointwise by one or more notches but rather over its entire extent. In both cases, there is an increased flow noise at the valve seat, which can be explained, i.e., by the collapsing of the cavitation bubbles.

According to the invention the produced operating noise of the pump, and therewith also that of the valves, is measured as structure-borne sound. This can be done in an embodiment of the invention by means of a structure-borne sound sensor or a microphone, in particular, however, by means of a vibration acceleration sensor, which preferably works according to the piezoelectric compression principle and can possess an integrated charge amplifier.

According to the invention, the produced structure-borne sound can be measured at the pump head, in particular at a central point thereof. Instead of this however, it is also possible to measure the produced structure-borne sound at or near the valve in question. This can be the intake or pressure valve, but in addition also the additional hydraulic valves provided on the pump body, which serve for leakage compensation or for draining off excess hydraulic fluid.

To carry out the comparison, provided according to the invention, between the effective signal level and the reference signal level, it is desirable to draw not on the respective instantaneous value measured by the structure-borne sound sensor but rather instead such a value averaged over a certain time period.

For this purpose, the invention provides various possibilities. Thus, it is possible in the embodiment of the invention to average the reference signal levels formed from the operating noise of the pump with intact valves over a predefined time period. Also, the effective signal level formed from the increased operating noise of the pump with valves which have become leaky can be averaged over a predefined time period.

As the predefined averaging time period those during several pump strokes can be used, for example, or also those during a fraction of the pump stroke cycle. In the latter case the evaluation of the signals is done within a defined time window in the stroke cycle. For this, according to the invention, a trigger signal is used which is generated at a defined point in time of the pump stroke cycle. This can, for example, be done in the intake stroke final position of the piston. The trigger signal advantageously does not have to satisfy very high precision requirements. Thus, for example, a precision of the crank angle of +/−5° is sufficient. In this case, for the monitoring of the intake valve in a defined time period, the produced structure-borne sound is recorded and compared during the displacement phase (pressure stroke). In contradistinction thereto, for the monitoring of the pressure valve, the corresponding time period in the intake phase (intake stroke) is taken as the basis. The defined time period can, merely by way of example, extend, for the monitoring of the pressure valve, over a range of 90–160° of the crank angle, while, for the monitoring of the intake valve, a defined time period which extends over a range of 270–340° of the crank angle is sufficient.

The advantages which follow with the evaluation of the signals within a defined time window in the pump stroke cycle consist, i.e., of the fact that leakiness can be distinguished precisely at the intake valve as well as at the pressure valve, that the sensitivity of the measurement is very high, and that interfering sources of sound, e.g. those from the drive system, can be easily filtered out by, for example, the time window, within which the measurement is done, being defined appropriately large or small The generation of the trigger signal can be done according to the invention in various ways, for example, by means of a contact sensor mounted on the pump drive mechanism, by means of a corresponding sampling of the piston rod, by means of recording a characteristic signal in the produced structure-borne sound, e.g. due to the play envelope in the drive mechanism, and also with the aid of the characteristic signals, e.g. of the respective measured pressure in the air space of the hydraulic storage area or in the drive mechanism.

As a reference signal level, in accordance with the aim of the invention, that reference value is taken which is assigned to an intact valve. This reference value can be recorded in different ways, for example, by measurement in fault-free condition of the valve under operating conditions, by a selection from predefined values, e.g. from a matrix with defined values for different valve embodiments and operating conditions, from a characteristic field determination, that is, a computational determination from valve data and operating data such as displacement pressure, fluid, etc., and the like.

In the aforementioned process in which the reference signal level, as well as the effective signal level, is averaged over a certain time period during a fraction of the pump cycle, the average value can, according to the invention, be formed from a number of pump strokes. With this, the automatic early fault detection process becomes, according to the invention, insensitive to short-term faults. This can, for example, be reasonable if contaminated fluids are being dosed by means of the pump in question. Due to fluid particles which are unintentionally caught between the valve seat and valve closing body, a fluid back-flow occurs in individual pump strokes which however, because they only occur short-term and transiently, should still not be displayed as a fault.

An additional embodiment of the process according to the invention can consist of the fact that, for a number of pump strokes before their further signal processing, a certain number of pump strokes with extreme values or with implausible values are discarded.

Thus, let merely one example be given that the signal values of 100 pump strokes can be recorded, where every three pump strokes with the highest as well as with the lowest individual values are discarded. For the additional signal processing the average value is then formed from the remaining 94 values.

So that not only a current valve error can be displayed, it lies within the scope of the invention to store the errors occurring with a corresponding time indication in storage or to report these errors to superior control systems. This is particularly advantageous when valve leakiness occurs only partially and the leakiness is not caused by wear but rather, for example, by partially impure fluid.

In an additional embodiment of the invention it is provided that the structure-borne sound produced by the respective valve is amplified by means of valve inserts. These are in particular inserts at the valve seat whose purpose it is to be induced to vibrate due to the leakage back-flow in order to achieve an amplification of the structure-borne sound signal.

In an extension of the invention it can be advantageous to evaluate only a defined frequency band of the measured signals in order to increase the spacing from the general noise signal.

Finally, it lies within the scope of the invention to mask individual measured data such as, for example, a play envelope in the drive mechanism from the observed time window. In this case, the existence of an exact trigger signal is then advantageous.

The device provided according to the invention for carrying out the described process is provided with a measuring device attached to a structural part of the pump, said device monitoring and measuring as an effective signal level the increased operating noise produced by a leaky valve due to the back-flow of the fluid being pumped in the closed state of the valve, and with a comparator device connected to the measuring device, said comparator device comparing the effective signal level to a reference signal level formed from the operating noise of the pump with intact valve and, at a predefined level deviation or change, generating a fault message as an early fault detection.

Advantageously the measuring device comprises at least one sensor to record the structure-borne sound produced by the operating noise of the pump. In this case, this structure-borne sound sensor can be a vibration accelerator sensor, preferably working piezoelectrically.

In an embodiment of the invention, the measuring device can be connected to the pump head, in particular to a central point thereof. Instead of this, it is also possible to provide the measuring device directly on or near the pump valves, that is, the intake and pressure valve as well as the additional hydraulic valves.

If desired, the structure-borne sound produced can, according to the invention, be amplified by means of suitable inserts in the valve seat. For this purpose, a vibration device is provided which is provided at or near the valve seat.

A vibration device of this type can consist of at least one wing mounted obliquely in the valve or, however, of a membrane sheet metal ring which is mounted in the valve seat.

These and other objects of the invention, as well as many of the intended advantages thereof, will become more readily apparent when reference is made to the following description taken in conjunction with the accompanying drawings.

BRIEF DESCRIPTION OF THE DRAWINGS

The invention will be explained in the following with the aid of the drawings. Shown therein are.

DETAILED DESCRIPTION OF THE PREFERRED EMBODIMENTS

Figure 1:
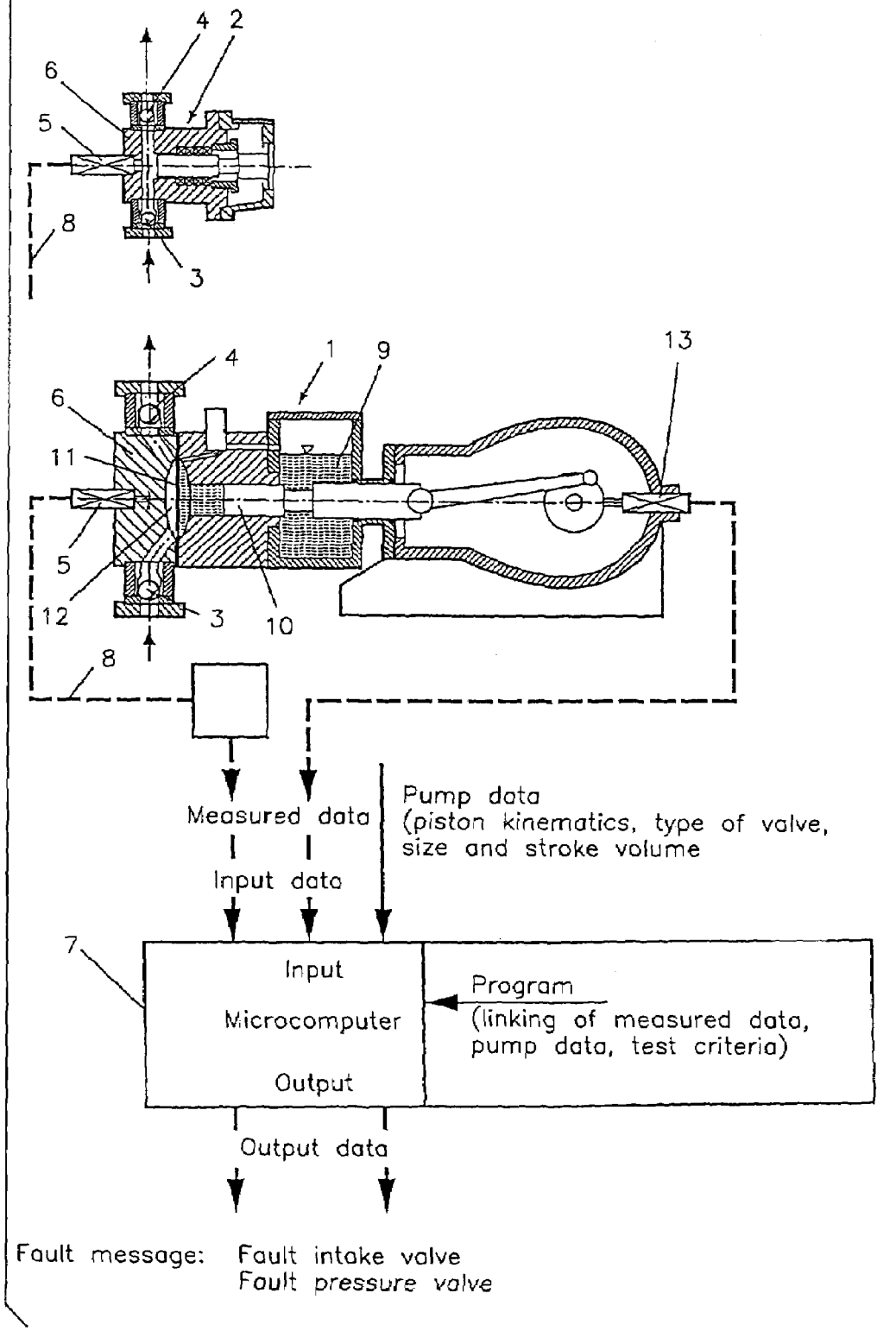
FIG. 1 illustrates schematically, in section, the application of the process as well as the device according to the invention in the case of a membrane dosing pump as well as in the case of a piston pump.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As represented in FIG. 1 schematically, the process and the device according to the invention find use in the case of a membrane dosing pump 1 as well as in the case of a piston pump 2. Therein it rotates around it, for each of the intake valves 3 and pressure valves 4 provided, which, in the embodiment example represented, are each structured as pressure-controlled ball valves, to carry out early fault detection.

For this purpose, a measuring device 5 is provided which is connected to a central point of the pump cover 6 and which monitors as well as measures the effective signal level of the increased operating noise produced by a leaky valve 3 or 4 due to the back-flow of the fluid being pumped in the closed state of the valve.

The measuring device 5 is formed for the measurement of the respective structure-borne sound produced by operating noise and comprises a corresponding sensor. This is, in the embodiment example represented, a vibration accelerator sensor working piezoelectrically.

Furthermore, a comparator device 7 is provided which compares the effective signal level supplied by the measuring device 5 via a signal line 8 to a reference signal level formed from operating noise of the pump with intact valves 3 or 4 and, at a predefined level deviation or change, generating a fault message as an early fault detection.

Figure 2A:
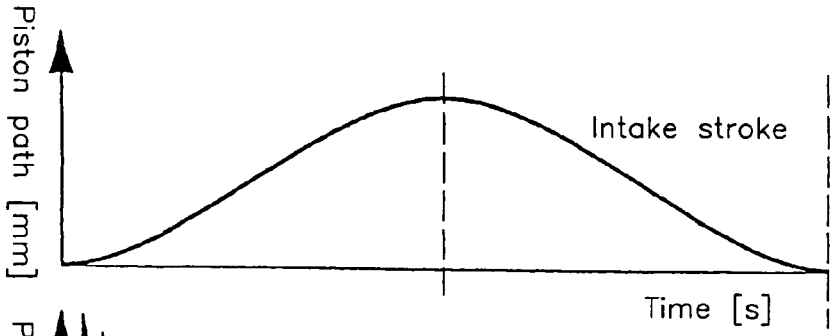
FIG. 2*a* is a diagram of the piston path of the pump over time.

As can be seen in detail from FIGS. 2*a*–2*e*, the various diagrams shows the characteristics of the membrane dosing pump 1 according to FIG. 1. Therein the piston path over time is represented in FIG. 2*a*.

Figure 2B:
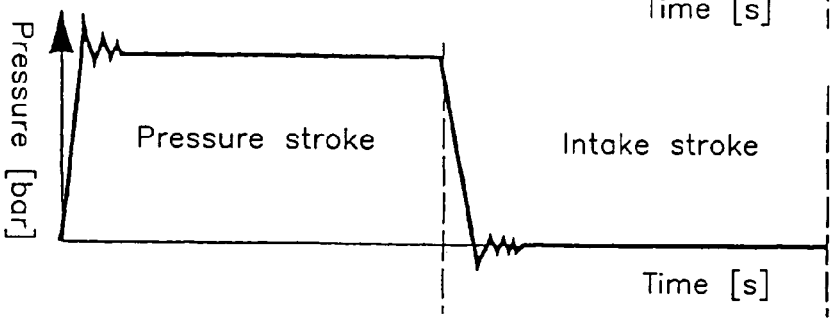
FIG. 2*b* is a diagram of the curve as a function of time of the pressure stroke as well as the intake stroke of the membrane dosing pump.

FIG. 2*b* shows, in contradistinction thereto, the pressure curve in the hydraulic area 9 of the pump 1, where clearly the characteristic curve of the pressure stroke to be executed by the piston 10 as well as the intake stroke of the membrane 11 (see FIG. 1) can be seen.

Figure 2C:
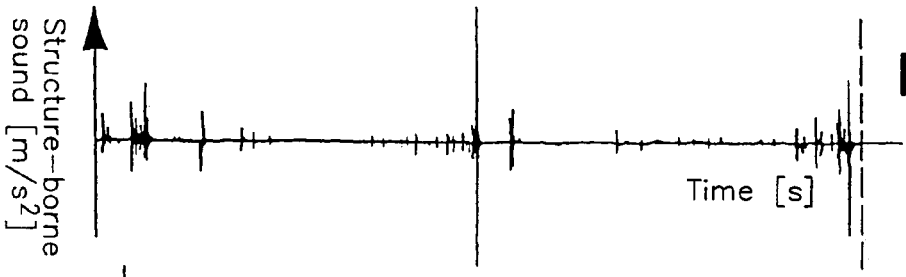
FIG. 2*c* illustrates the reference signal level measured as structure-borne sound of an intact pump valve in the case of the pressure stroke as well as in the case of the intake stroke.

As can be seen from FIG. 2*c*, the curve of the operating noise, produced by a pump 1 with intact valves 3 or 4 and measured as structure-borne sound, is structured in the typical manner, where the curve represented in FIG. 2*c* represents the reference signal level. This reproduces typical noise peaks which are produced during the pressure stroke and intake stroke executed by the pump piston 10.

Figure 2D:
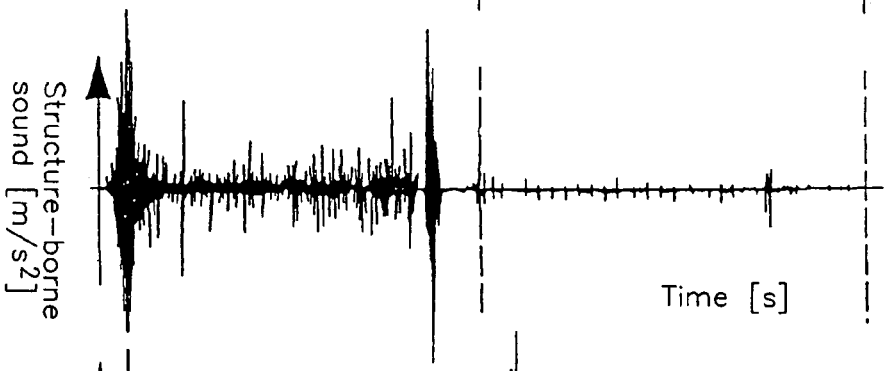
FIG. 2*d* illustrates the effective signal level in the case of a defective intake valve.

In contradistinction thereto, FIG. 2*d* shows the curve of the structure-borne sound of a pump 1 with a defective intake valve 3, said curve typically appearing during the pressure stroke executed by the piston 10 since therein the intake valve 3 no longer closes exactly due to the leakiness occurring and thus permits an undesired leakage flow into the intake line.

Figure 2E:
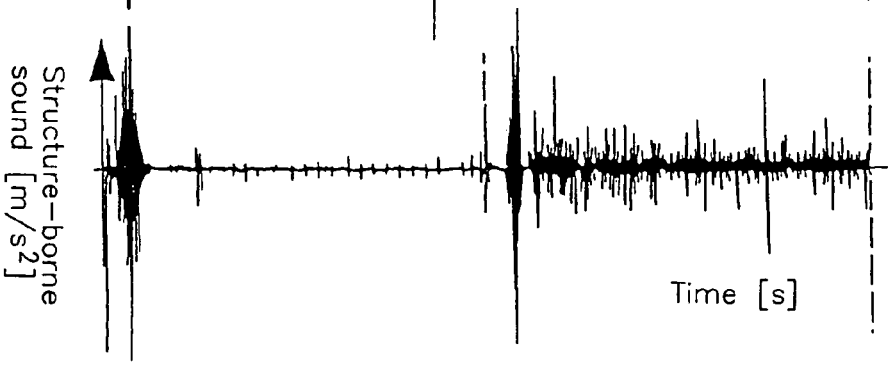
FIG. 2*e* illustrates the effective signal level in the case of a defective pressure valve.

In contradistinction thereto, FIG. 2*e* shows the structure-borne sound signal in the case of a pump 1 with a defective pressure valve 4. This occurs, as represented, in the intake stroke of the piston 10 since here the pressure valve 4 becoming leaky, no longer closes reliably, and permits an undesired back-flow in the form of a leakage flow into the fluid area 12 of the pump 1.

Figure 3A:
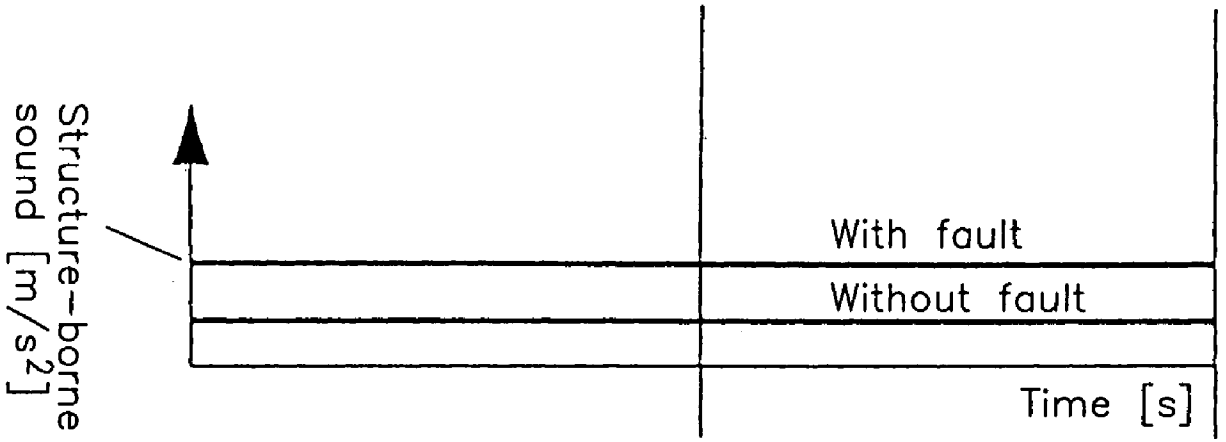
FIG. 3*a* illustrates the reference signal level as well as the effective signal level in a time average over several pump strokes.
Figure 3B:
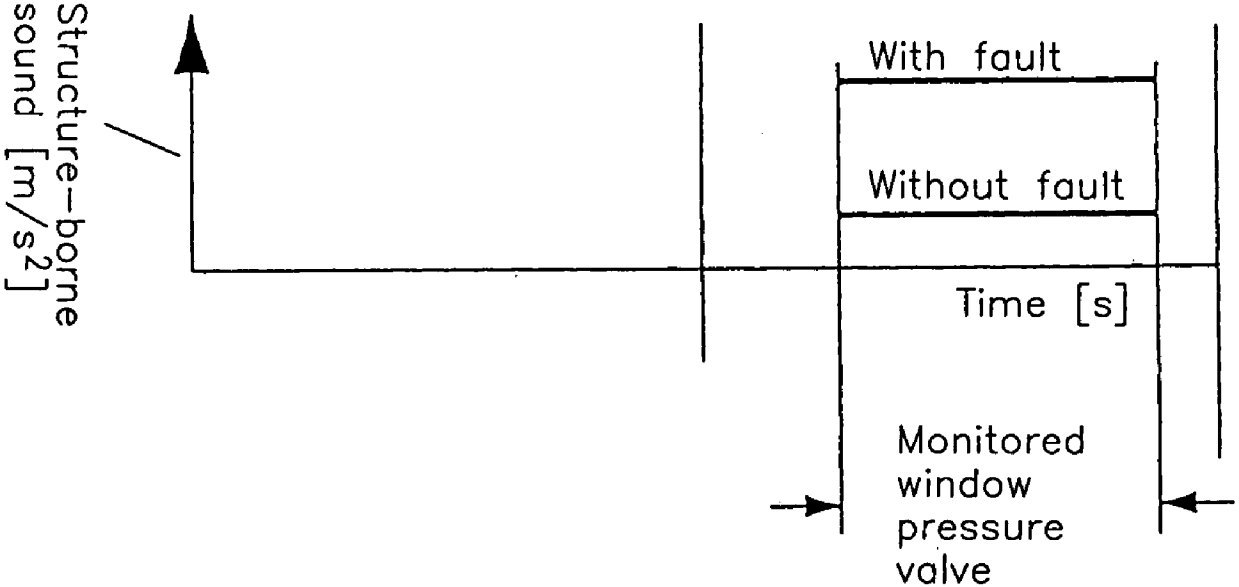
FIG. 3*b* illustrates in a time-limited average, that is, in a defined time window within the stroke cycle.

Finally, FIGS. 3*a* and 3*b* show the level curve of the measured structure-borne sound signal in averaged form, where in FIG. 3*a* the averaging period during several pump strokes, i.e. several times during the pressure stroke as well as the intake stroke, is represented and early fault detection is permitted due to an increased effective signal level. In contradistinction thereto, FIG. 3*b* shows the signal curve in an averaging time period which extends merely over a fraction of the pump stroke cycle, in the case represented during only one defined time of the intake stroke.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. Process for the monitoring and automatic early fault detection in valves of an oscillating displacement pump, said process comprising the steps of continuously monitoring operating noise produced by a leaky pump valve as structure-borne sound due to back-flow of fluid pumped in a closed state of the pump valve, measuring the structure-borne sound by at least one vibration acceleration sensor, using the monitored operating noise as a measure for leakiness of the pump valve by a generated effective signal level, comparing the generated effective signal level to a reference signal level formed by operating noise of the pump with an intact pump valve, and triggering early fault detection of the leaky pump valve at a predefined signal level deviation or change due to increased operating noise of the leaky pump valve.

2. Process according to claim 1, wherein the structure-borne sound is measured at a central point of a pump head.

3. Process according to claim 1, wherein the structure-borne sound is measured at or near the valve.

4. Process according to claim 1, wherein the reference signal level formed from the operating noise of the pump with intact valves is averaged over a predefined time period.

5. Process according to claim 1, wherein the effective signal level formed from the operating noise of the pump with valve which has become leaky is averaged over a predetermined time period.

6. Process according to claim 5, wherein the predetermined time period is over several pump strokes.

7. Process according to claim 5, wherein the predetermined time period is over a fraction of a pump cycle.

8. Process according to claim 7, wherein to form an average value of the respective signal levels, a trigger signal generated at a defined point in time in a pump stroke cycle is used.

9. Process according to claim 8, wherein the trigger signal is generated by a contact sensor mounted on a pump drive mechanism.

10. Process according to claim 1, wherein the structure-borne sound produced by the valve is amplified by valve inserts.

11. Device for carrying out a process for the monitoring and automatic early fault detection in valves of an oscillating displacement pump, said process comprising the steps of continuously monitoring operating noise produced by a leaky pump valve due to back-flow of fluid pumped in a closed state of the pump valve and using the monitored operating noise as a measure for leakiness of the pump valve by a generated effective signal level, comparing the generated effective signal level to a reference signal level formed by operating noise of the pump with an intact pump valve, and triggering early fault detection of the leaky pump valve at a predefined signal level deviation or change due to increased operating noise of the leaky pump valve, said device comprising a measuring device attached to a structural part of the pump, said device monitoring and measuring as the effective signal level the operating noise produced by a leaky valve due to the back-flow of the fluid pumped in the closed state of the valve, and a comparator device connected to the measuring device, said comparator device comparing the effective signal level to the reference signal level formed from the operating noise of the pump with the intact valve and, at the predefined signal level deviation or change, generating a fault message as the early fault detection of the leaky valve, the measuring device including at least one sensor to record the structure-borne sound produced by the operating noise of the pump, the structure-borne sound sensor being a vibration acceleration sensor.

12. Device according to claim 11, wherein the measuring device is attached to a central point of a pump head.

13. Device according to claim 11, wherein the measuring device is provided at or near the pump valve.

14. Device according to claim 11, wherein the pump valve comprises a vibration acceleration device for amplification of the structure-borne sound signal, said device being provided near a valve seat.

15. Device according to claim 14, wherein the vibration acceleration device consists of at least one wing mounted obliquely in the valve.

16. Device according to claim 14, wherein that the vibration acceleration device is a membrane sheet metal ring.

* * * * *